US006808602B2

(12) United States Patent
Schonfeld et al.

(10) Patent No.: US 6,808,602 B2
(45) Date of Patent: Oct. 26, 2004

(54) COKE DRUM BOTTOM HEAD REMOVAL SYSTEM

(75) Inventors: Sergio Gustavo Schonfeld, Santa Maria, CA (US); Kenneth Allan Larson, Santa Maria, CA (US); Rodney Karl Hogan, Arroyo Grande, CA (US)

(73) Assignee: ConocoPhillips Company, Houston, TX (US)

( * ) Notice: Subject to any disclaimer, the term of this patent is extended or adjusted under 35 U.S.C. 154(b) by 738 days.

(21) Appl. No.: 09/841,979

(22) Filed: Apr. 25, 2001

(65) Prior Publication Data

US 2002/0157936 A1 Oct. 31, 2002

(51) Int. Cl.[7] ..... C10B 25/00; C10B 39/06

(52) U.S. Cl. ..... 202/242; 202/211; 202/266; 202/253; 202/252; 202/227; 202/239; 202/242; 202/244; 202/245; 414/684.3; 414/589; 201/31; 201/41; 208/127

(58) Field of Search ..... 414/684.3, 589; 202/244, 245, 242, 239, 227, 252, 253, 211, 266; 201/31, 41; 208/127

(56) References Cited

U.S. PATENT DOCUMENTS

| | | | | |
|---|---|---|---|---|
| 2,595,245 | A | | 5/1952 | Grandinetti et al. |
| 2,734,824 | A | * | 2/1956 | De Luca ..... 220/324 |
| 4,299,332 | A | | 11/1981 | Pechacek |
| 4,313,709 | A | | 2/1982 | Herman |
| 4,347,944 | A | | 9/1982 | Moldrup |
| 4,398,646 | A | | 8/1983 | Pechacek |
| 4,432,128 | A | | 2/1984 | Pechacek et al. |
| 4,611,613 | A | | 9/1986 | Kaplan |
| 4,722,557 | A | | 2/1988 | Bormioli |
| 4,726,109 | A | | 2/1988 | Malsbury et al. |
| 4,730,850 | A | | 3/1988 | Takahashi |
| 4,820,384 | A | | 4/1989 | Pechacek |
| 4,960,358 | A | | 10/1990 | DiGiacomo et al. |
| 5,048,876 | A | | 9/1991 | Wallskog |
| 5,092,963 | A | | 3/1992 | Barker et al. |
| 5,098,524 | A | | 3/1992 | Antalfy et al. |
| 5,221,019 | A | | 6/1993 | Pechacek et al. |
| 5,228,825 | A | | 7/1993 | Fruchtbaum et al. |
| 5,259,930 | A | | 11/1993 | Barker et al. |
| 5,290,076 | A | | 3/1994 | Smith |
| 5,294,157 | A | | 3/1994 | Smith et al. |
| 5,336,375 | A | | 8/1994 | Wallskog et al. |
| 5,500,094 | A | | 3/1996 | Fruchtbaum et al. |
| 5,570,911 | A | | 11/1996 | Galle |
| 5,581,864 | A | | 12/1996 | Rabet |
| 5,628,603 | A | | 5/1997 | Antalffy et al. |
| 5,707,089 | A | | 1/1998 | Fend |
| 5,716,205 | A | * | 2/1998 | Tratz ..... 432/103 |
| 5,785,843 | A | | 7/1998 | Antalffy et al. |
| 5,876,568 | A | | 3/1999 | Kindersley |
| 5,947,674 | A | | 9/1999 | Malsbury et al. |
| 6,022,454 | A | | 2/2000 | Fetzer |
| 6,254,733 | B1 | * | 7/2001 | Lu et al. ..... 202/245 |
| 6,264,797 | B1 | * | 7/2001 | Schroeder et al. ..... 201/39 |
| 6,264,829 | B1 | * | 7/2001 | Antalffy et al. ..... 208/131 |
| 6,367,843 | B1 | * | 4/2002 | Fetzer ..... 285/24 |
| 6,423,188 | B1 | * | 7/2002 | Fetzer ..... 202/242 |

* cited by examiner

*Primary Examiner*—Glenn Caldarola
*Assistant Examiner*—Alexis Wachtel

(57) ABSTRACT

A coke drum bottom head removal system and method for deheading the bottom head cover of a coke drum comprises a carriage that is positionable beneath the bottom head cover, and a cart mounted to the carriage. Several clamps vertically mounted to the cart are positionable in a closed position, in which the clamps apply a compressive force that maintains substantially fluid tight engagement between the bottom head cover and bottom head flange, and an opened position, in which the clamps allow a limited spacing between the bottom head cover and the bottom head flange. A plurality of supports mounted to the cart support the bottom head cover once the fasteners coupling the bottom head cover to the bottom head flange are removed and the clamps are in the opened position. The system can be remotely operated to enhance operator safety when the bottom head cover is removed.

17 Claims, 11 Drawing Sheets

COKE DRUM BOTTOM HEAD REMOVAL SYSTEM

BACKGROUND OF THE INVENTION

1. Field of the Invention

The present invention relates generally to the removal of head covers from coke drums, and more particularly to devices and methods for the safe removal of bottom head covers from coke drums.

2. Description of the Related Art

Coke drums are vertical pressure vessels used in the refining of crude oil for the coking of various heavy hydrocarbon materials. The coking process generally involves placing petroleum residues inside the coke drum and cracking them into light products and a solid coke residue. This is accomplished by exposing the residues to elevated temperatures (typically approximately 900° F.) and pressures (typically approximately 10 to 30 psig).

Coke is a hard, coal-like substance which builds up inside the coke drum during the coking process. Once the coke drum is full of coke, the coke drum is "decoked" by introducing steam and water into the coke drum to quench the temperature to approximately 200° F. The quench water is then drained via piping to a storage tank. After draining the quench water, the top head and bottom head of the coke drum are removed (or "deheaded") to provide access to the inside of the coke drum. The coke is then cut away using high pressure hydraulic drilling, permitting it to fall from the coke drum into a chute positioned at the bottom opening to direct the removed coke to a desired location.

The loosening and removal of the bottom head entails risk to personnel in the vicinity of the bottom head during deheading. In this regard, the quench water, hydrocarbon material, and coke remaining inside the coke drum are still quite hot after the quench water is drained. Accordingly, when the residual quench water is drained through the loosened bottom head cover, the hot quench water and steam pose a risk to personnel in the area. In addition, the quench water, hydrocarbon material and loose coke resting on the bottom head cover are quite heavy. The weight of these materials can result in the failure of the equipment or other structures supporting the bottom head cover as it is removed, thereby posing an additional potential risk.

Accordingly, a need has existed for a device and method for the removal of the bottom head cover of a coke drum that is relatively easy to use, reduces risks and maximizes the safety for the operator. The present invention satisfies these and other needs and provides further related advantages.

SUMMARY OF THE INVENTION

The present invention provides a coke drum bottom head removal system for removing a bottom head attached by fasteners to a bottom head flange of a coke drum. The system comprises a carriage that is positionable beneath the bottom head cover, and a cart mounted on the carriage that can be moved vertically between a raised position and a lowered position. The system also comprises a plurality of clamps and supports mounted on the cart. In accordance with the invention the system is operable from a remote location to reduce risks and maximize safety for the operator.

In the preferred embodiment, the carriage is suspended by trolleys from a pair of overhead tracks positioned along opposite sides of the bottom head cover. The cart is preferably suspended from an upper portion of the carriage by a plurality of hoists. These hoists are operated to raise and lower the cart with respect to the carriage when the carriage is positioned beneath the bottom head cover.

Each of the clamps mounted on the cart comprises an upper clamping surface, such as a fixed jaw, adapted for engagement with the bottom head flange. Each clamp also comprises a lower clamping surface, such as a movable ram, adapted for engagement with the bottom head cover. The clamps are actuated between a closed position, in which the clamping surfaces apply a compressive force that maintains a substantially tight fluid engagement between the bottom head flange and the bottom head cover upon removal of the fasteners, and an opened position, in which the clamping surfaces are moved apart to permit a limited spacing between the bottom head flange and the bottom head cover when the fasteners are removed.

In use, the carriage is positioned beneath the bottom head cover, with the cart in the lowered position. A plurality of the fasteners connecting the bottom head cover to the bottom head flange are removed, exposing fastener holes. The cart is then moved to the raised position such that the supports are inserted into a plurality of the fastener holes. The clamps are then positioned for engagement with the bottom head cover and the bottom head flange and moved to the closed position.

With the clamps in the closed position, the remaining fasteners are removed. The compressive force applied by the clamps maintains a substantially fluid tight engagement between the bottom head flange and the bottom head cover when the fasteners are removed. Since the fasteners are removed manually, the clamps ensure operator safety while the fasteners are being removed.

Once the fasteners are removed, the operator, from a remote location, reduces the compressive force applied by the clamps, moving them to the opened position. This allows the bottom head cover to be lowered onto a support surface of each support. The lowering of the bottom head cover creates a space between the bottom head cover and the bottom head flange through which residual quench water drains.

When the quench water and other materials in the coke drum have drained, the cart is moved to the lowered position. This disengages the supports from the fastener holes in the bottom head flange, with the bottom head cover remaining on the cart and supported by the supports. The carriage can then be moved to transport the bottom head cover away from the bottom head to permit further decoking of the coke drum.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1A:
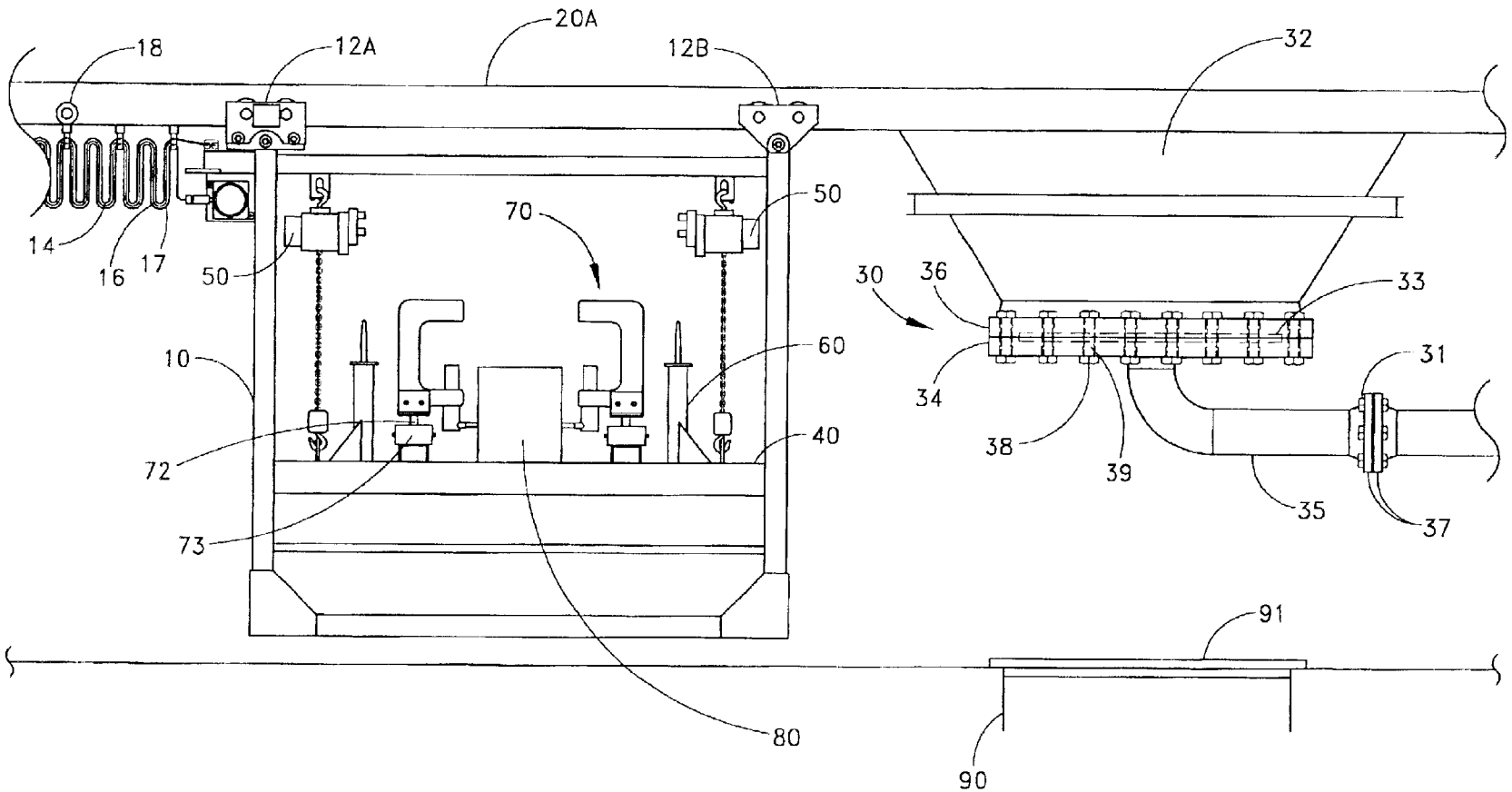
FIGS. 1A and 1B are schematic elevational views of a coke drum bottom head removal system embodying the novel features of the present invention.
Figure 1B:
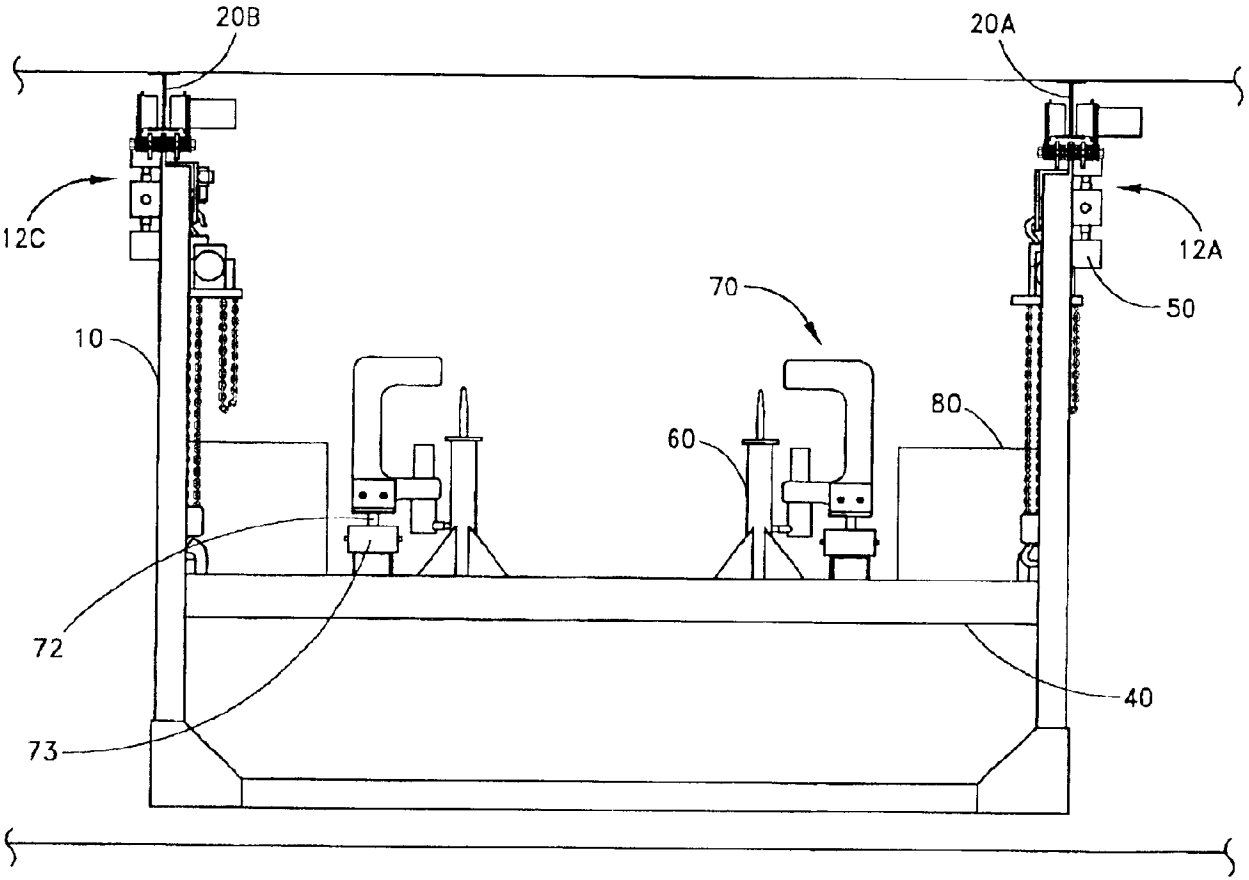

As shown in the exemplary drawings, the present invention is embodied in a coke drum bottom head removal unit for removing the bottom head cover of a coke drum. Referring to FIGS. 1A and 1B, a preferred embodiment of the present invention comprises a carriage 10 suspended by a plurality of trolleys 12 coupled to a pair of parallel overhead tracks 20A and 20B positioned along opposite sides of a bottom head 30 of a coke drum 32. The bottom head 30 comprises a bottom head cover 34 fastened to a bottom head flange 36 by a plurality of fasteners, such as bolts 38, extending through bolt holes 39 positioned along the perimeter of both the bottom head cover 34 and the bottom head flange 36.

The carriage 10 has a cart 40, a plurality of hoists 50, a plurality of elongated supports 60, a plurality of clamps 70, and at least one hydraulic pump 80. The hoists 50 are fastened to the carriage 10 and to the cart 40, thereby suspending the cart 40 from the carriage 10. The supports 60 are fixedly mounted vertically to the cart 40, the clamps 70 are mounted via rotatable shafts 72 to the cart 40 in a vertical orientation, and the hydraulic pumps 80 are fixedly mounted to the cart 40. The angular position of each clamp 70 about its rotatable shaft 72 is adjusted by a rotary actuator 73 coupled to each rotatable shaft 72.

In the flooring below the bottom head 30 is a chute 90 through which materials removed from the coke drum 32 can be directed to a desired location. The chute 90 is covered by a cover grate 91 when not in use. A control panel 100 (illustrated in FIG. 4) is coupled to one or more of the trolleys 12, hoists 50, clamps 70, rotary actuators 73, hydraulic pumps 80, and chute 90, and most preferably the control panel is coupled to all of these components. The control panel 100 enables the various components of the preferred embodiment of the present invention to be controlled remotely, thereby keeping personnel away from the bottom head 30 during the hazardous stages of the deheading process.

The plurality of trolleys 12 enable the carriage 10 to be translated along the pair of parallel tracks 20A, 20B into position below the bottom head 30. When not in use, the carriage 10 is translated away from the bottom head 30, as illustrated in FIG. 1A. In the preferred embodiment, the pair of parallel tracks 20A, 20B extends between the bottom heads of two adjacent coke drums. In this way, the carriage 10 can be used to dehead both adjacent coke drums at different times.

In the preferred embodiment, the plurality of trolleys 12 comprises four pneumatically-actuated trolleys 12A–12D, with two trolleys 12A, 12B coupled to one track 20A, and two trolleys 12C, 12D coupled to the other track 20B. The parallel tracks 20A, 20B of the preferred embodiment are steel I-beams securely fastened overhead to a ceiling. The overhead tracks 20A, 20B and the trolleys 12A–12D are able to support the combined weight of the carriage 10 and the bottom head cover 34. The trolleys 12A–12D are positioned substantially symmetrically to evenly bear the weight load of the carriage 10 and the bottom head cover 34. In other embodiments, the plurality of trolleys 12 may comprise a number of trolleys 12 other than four. In addition, other embodiments may include trolleys 12 that are electrically-actuated or manually-actuated. Persons skilled in the art can recognize that other configurations of trolleys 12 and tracks 20 are compatible with the present invention.

Electrical power and electronic control signals are supplied to the trolleys 12, hoists 50, rotatable shafts 72, and hydraulic pumps 80 via an electrical cable 14. Pressurized air to operate the trolleys 12, hoists 50, rotary actuators 73, and hydraulic pumps 80 is provided via a supply air hose 16, and a return air hose 17. In the preferred embodiment, the air hoses 16 and 17 are fifty foot recoil nylon hoses, with a ¾" inner diameter, which are available from Ingersoll-Rand as Item #134–508.

The electrical cable 14 and the air hoses 16, 17 preferably are suspended from a hose trolley 18 which travels along one of the tracks 20. In the preferred embodiment, the hose trolley 18 has approximately seven segments, and is available from Ingersoll-Rand as Item #7703. The electrical cable 14 and the air hose 16 are festooned from the hose trolley 18 so as to provide adequate slack across the whole range of travel of the carriage 10 between the coke drum 32 and a second coke drum (not shown). It will be appreciated that persons skilled in the art can select other configurations to provide the appropriate electrical, pneumatic and other power supplies to the various components of the present invention.

The coke drum 32 is a vertically-oriented vessel supported by a platform and frame structure. Coke drums used in petroleum refineries are typically 80 to 100 feet tall and 18 to 30 feet in diameter, tapering down to approximately 4 to 7 feet in diameter in the region of the bottom head 30. The bottom head cover 34 and bottom head flange 36 are typically 4 to 7 feet in diameter, fastened together by approximately 20 to 60 fasteners or bolts 38. Between the bottom head cover 34 and the bottom head flange 36 is a seal 33 which helps prevent leakage of material from the inside of the coke drum 32.

The bottom head cover 34 includes a lateral pipe 35 used for feeding hydrocarbon material, steam, and water into the coke drum 32. This lateral pipe 35 is also used to drain hydrocarbon materials and water from the coke drum 32 following the cooling of the temperature and prior to the deheading of the bottom head cover 34. A pair of lateral pipe flanges 37 are fastened together by fasteners 31, thereby connecting the lateral pipe 35 to additional piping structures.

In the preferred embodiment, the cart 40 is suspended from the carriage 10 by four pneumatically-actuated hoists 50 fastened to an upper portion of the carriage 10. The hoists 50 are able to support the combined weight of the cart 40 and the bottom head cover 34. The hoists 50 are preferably positioned substantially symmetrically along the perimeter of the carriage 10 and the cart 40 to evenly bear the weight load of the cart 40 and the bottom head cover 34. By adjusting the hoists 50, the cart 40 can be placed in a raised position, a lowered position, and a plurality of intermediate positions in relation to the carriage 10.

In other embodiments, the plurality of hoists 50 comprises a number of hoists 50 other than four. In addition, other embodiments may include hoists 50 that are electrically-actuated or manually-actuated. Furthermore, in other embodiments, the cart 40 is not suspended from the carriage 10, but is supported from below by a plurality of pneumatically-actuated jacks fastened to the carriage 10. By adjusting these jacks, the cart 40 can be placed in the raised position, the lowered position, or the plurality of intermediate positions. Persons skilled in the art can recognize that other configurations of the cart 40 and its mounting to the carriage 10 are compatible with the present invention.

Figure 2:
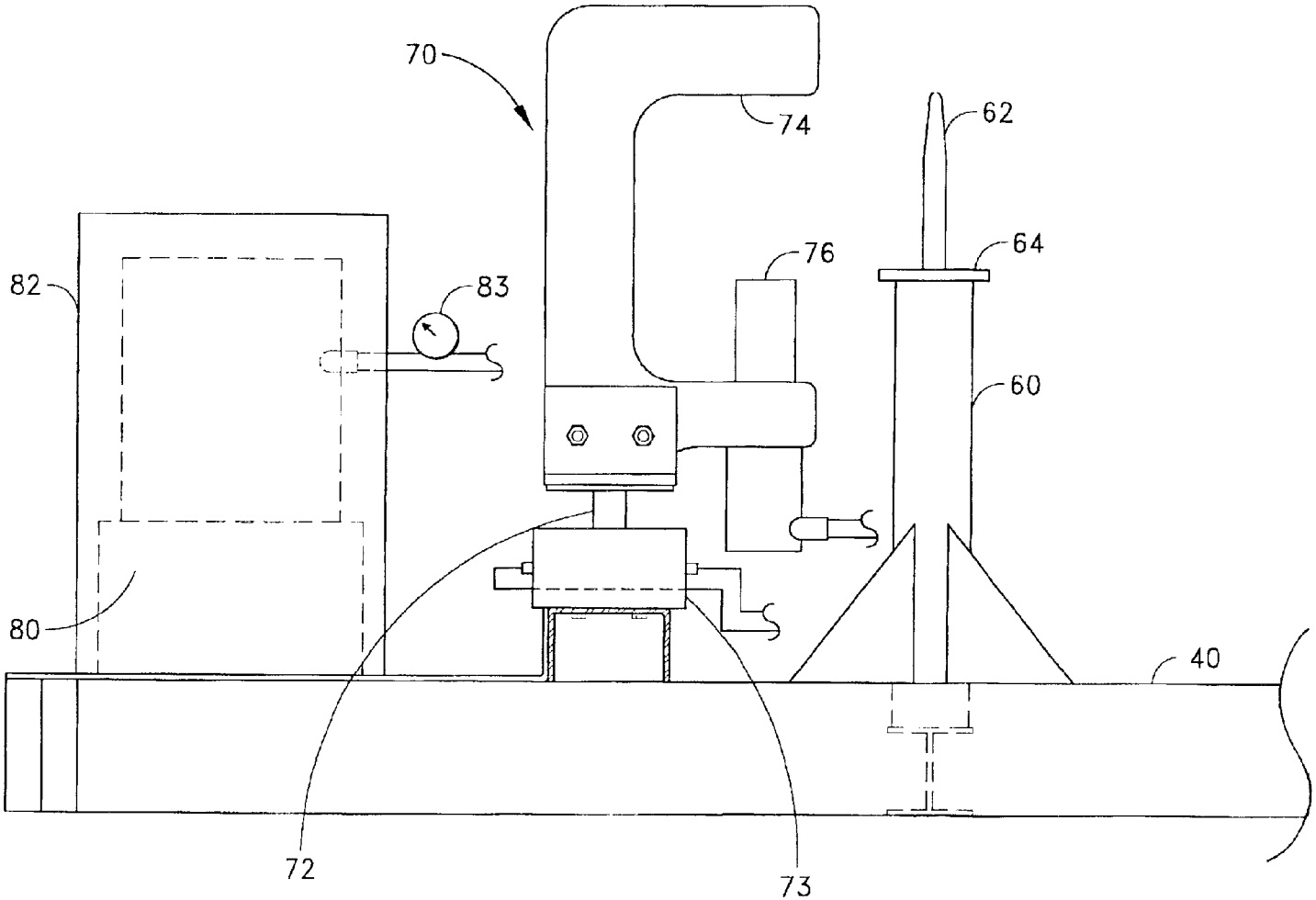
FIG. 2 is a schematic elevational view of certain features of the coke drum bottom head removal system, including a clamp, support, and hydraulic pump.
Figure 3:
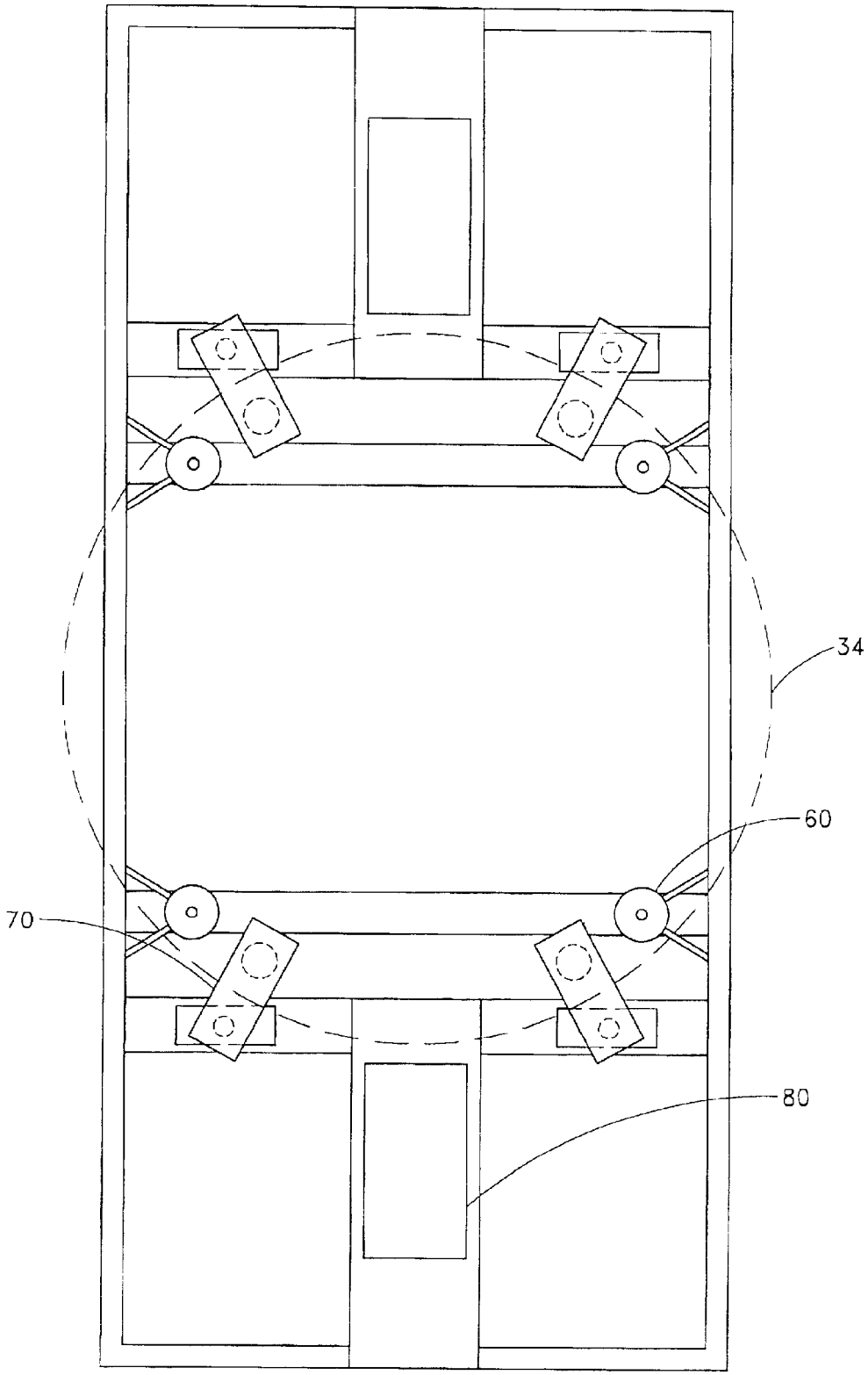
FIG. 3 is a schematic top plan view of the coke drum bottom head removal system, showing the orientation of the clamps and supports in relation to a cart and bottom head cover of the coke drum.

FIG. 3 shows a preferred embodiment, in which four supports 60 are vertically mounted to the cart 40. As further illustrated in FIG. 2, each support 60 has a narrow upper portion 62 and a shelf 64. When positioned below the bottom head cover 34, the supports 60 are positioned substantially symmetrically around the perimeter of the bottom head cover 34. In addition, the upper portion 62 of each support 60 is aligned with a corresponding bolt hole 39 located along the perimeter of the bottom head cover 34 and the bottom head flange 36.

After removing the bolts 38, the supports 60 are aligned with the bolt holes 39. The cart 40 is then moved to the raised position relative to the carriage 10 to engage the upper portion 62 of each support 60 with the corresponding hole 39 of the bottom head cover 34. When removed from the bottom head flange 36, the bottom head cover 34 rests on the shelf 64 of each of the supports 60. In other embodiments, the plurality of supports 60 comprises a number of supports 60 other than four. Persons skilled in the art can recognize that other configurations of supports 60 are compatible with the present invention.

In the preferred embodiment, four clamps 70 are vertically mounted to the cart 40 via rotatable shafts 72 and rotary actuators 73. Each clamp 70 is hydraulically-actuated, and has a first, upper clamping surface or jaw 74 and a second, lower clamping surface or ram 76, as illustrated in FIG. 2. The rotatable shafts 72 are each rotatable by a rotary actuator 73 which is pneumatically-actuated, thereby rotating each clamp 70 to an engaged position or a disengaged position. In the preferred embodiment, pressurized air is provided to each rotary actuator 73 via a pair of ¼" NPT pneumatic connections for supply and return. The rotary actuators 73 provide approximately 94° of rotation, and are available from Flo-Tork as Model #A-500. Pressurized hydraulic fluid is provided to each clamp 70 from at least one hydraulic pump 80 via, for example, a 0.38" I.D. rubber wire-braided hydraulic supply hose. Persons skilled in the art can recognize that other configurations of pneumatic and hydraulic systems are compatible with the present invention.

When the cart 40 is in the lowered position, the clamps are in the disengaged position to prevent the clamps 70 from hitting the bottom head cover 34 when the cart 40 is raised. Once the cart 40 is in the raised position, rotating a clamp 70 into the engaged position engages the jaw 74 of the clamp 70 with the bottom head flange 36. As noted above in the disengaged position, the jaw 74 and the ram 76 of each clamp 70 are rotated away from the bottom head cover 34 and bottom head flange 36 to permit vertical movement of the cart 40 without interference.

Alternatively, in other embodiments, the clamps 70 are vertically mounted to the cart 40 by non-rotatable shafts and translation actuators (not shown). These translation actuators translate the clamps 70 parallel to the upper surface of the bottom head flange 36 from the engaged position to the disengaged position. Furthermore, in other embodiments, the clamps 70 are vertically mounted to the cart 40 by shafts and actuators which provide both rotation and translation to position the clamps 70 in the engaged or disengaged positions.

By hydraulically actuating a clamp 70, its ram 76 is extended and any material between the ram 76 and the jaw 74 experiences a compressive force as it is squeezed between the ram 76 and the jaw 74. By controlling the hydraulic pressure provided to the clamp 70, the compressive force applied by the ram 76 and the jaw 74 of the clamp 70 can be adjusted from zero to 25 tons. In the preferred embodiment of the present invention, all the rams 76 are provided hydraulic pressure from a single hydraulic system to ensure equal compressive force at each clamp 70. The sum of the compressive forces applied by the clamps 70 is more than sufficient to fully support the combined weight of the bottom head cover 34 and the contents of the coke drum 32 weighing on the bottom head cover 34, thus providing a substantially fluid tight engagement preventing the leakage of quench water between the bottom head cover 34 and the bottom head flange 36.

As shown in FIG. 3, the clamps 70 preferably are positioned substantially symmetrically along the perimeter of the bottom head cover 34 to evenly bear the weight load of the bottom head cover 34 and the contents of the coke drum 32. In other embodiments, the plurality of clamps 70 comprises a number of clamps 70 other than four. In addition, other embodiments may include rotatable shafts 72 that are electrically-actuated or manually-actuated. Persons skilled in the art can recognize that other configurations of clamps 70 are compatible with the present invention.

The two hydraulic pumps 80 of the preferred embodiment are mounted on the cart 40, and each is covered by a pump shroud 82. In addition, each hydraulic pump has a 0–10,000 psi hydraulic pressure gauge 83, which is available from Power Team, Item #9063. Each hydraulic pump 80 is preferably driven by air pressure instead of electricity and is connected to the same pneumatic system as the rotary actuators 73 of the clamps 70. Driving the hydraulic pumps 80 pneumatically enables the reduction of the cost and complexity of the electrical system. Each hydraulic pump 80 comprises a solenoid valve 84 that is used to control the hydraulic pressure produced by the hydraulic pumps 80. By providing more than one hydraulic pump 80, the preferred embodiment of the present invention achieves faster pressurization of the rams 76, and provides redundancy in the event of failure of one hydraulic pump 80.

The chute 90 in the flooring beneath the bottom head 30 provides a conduit through which materials removed from the coke drum 32 can be directed to a desired location. When not in use, the chute 90 is covered by a lightweight cover grate 91 that is removed before the chute 90 is used. Once the bottom head cover 34 is removed from the bottom head 30, the carriage 10 is moved away from the bottom head 30, and the cover grate 91 is removed from the chute 90. A telescoping portion of the chute 90 is then raised to be in proximity to the bottom head 30. In this way, the chute 90 is able to catch materials from the coke drum 32 and direct these materials to a desired location. To raise and lower the chute 90, two air-operated hoists are used, the hoists being attached to opposite points on the chute 90 and controlled via buttons on the control panel 100.

Figure 4:
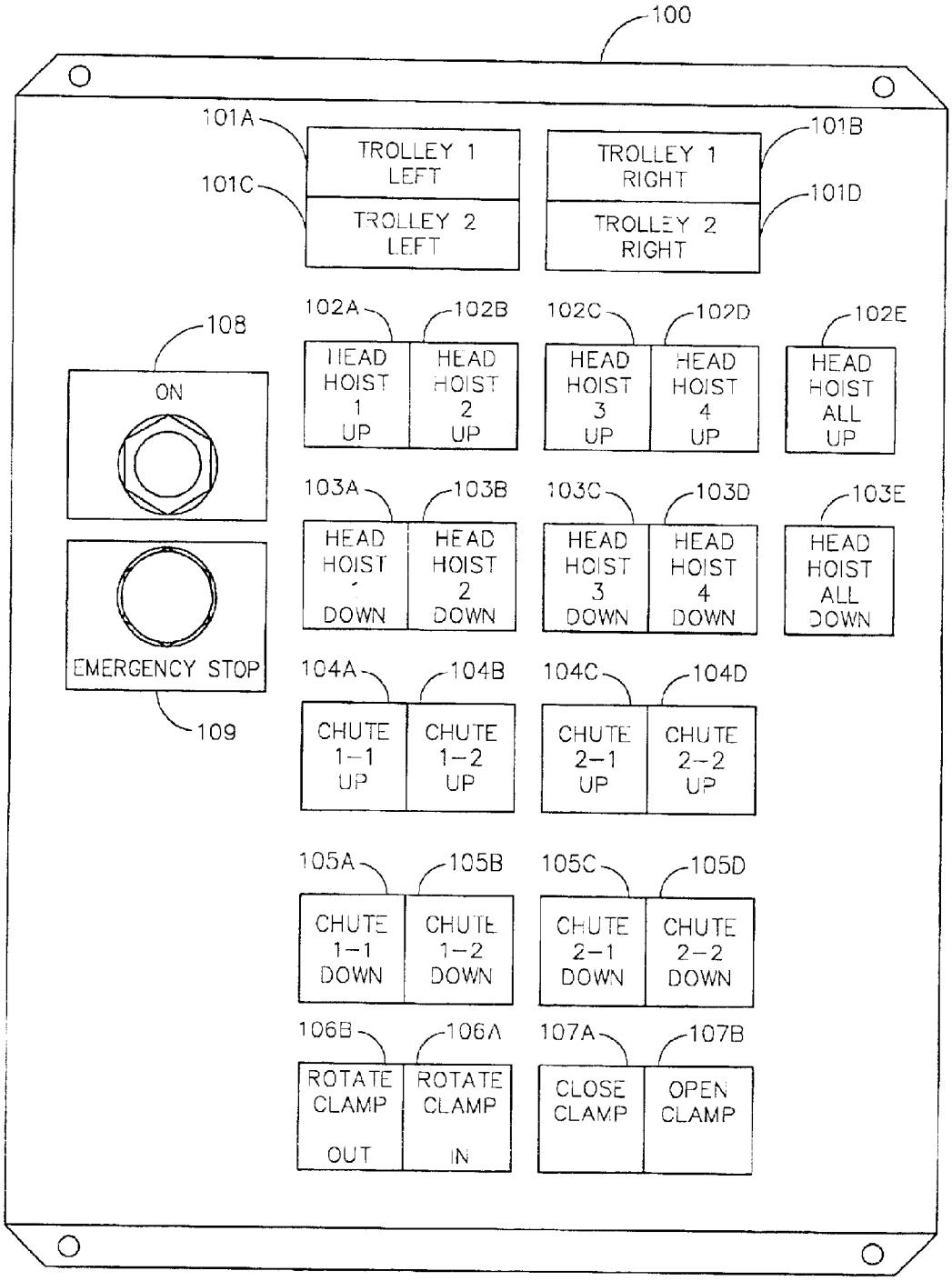
FIG. 4 is a schematic illustration of a control panel for use with the coke drum bottom head removal system.

The preferred embodiment of the present invention utilizes a control panel 100 as illustrated in FIG. 4. By pressing the appropriate buttons of the control panel 100, an operator can control the various features of the system from a location remote from the bottom head 30. In other embodiments, other configurations of control panels 100 can be used, including multiple control panels 100 to provide access to some or all of the functions in multiple locations. Control of the position of the trolleys 12 is provided by lighted buttons 101A–D. By pressing button 101A, the operator generates signals which correspond to the translation of trolleys 12A and 12B in one direction along track 20A, and button 101B corresponds to translation of trolleys 12A and 12B in the opposite direction along track 20A.

Similarly, buttons 101C and 101D on the control panel 100 correspond to the translation of trolleys 12C and 12D in two directions along the track 20B. Buttons 102A–D correspond to raising the four hoists 50 individually, and button 102E corresponds to raising the four hoists 50 together. Buttons 103A–D correspond to lowering the four hoists 50 individually, and button 103E corresponds to lowering the four hoists 50 together. Buttons 104A–B correspond to raising the chute 90 underneath the coke drum 32, and buttons 105A–B correspond to lowering the chute 90. Buttons 104C–D and buttons 105C–D correspond to the same operations for the chute 90 underneath a second coke drum (not shown).

Button 106A on the control panel 100 corresponds to rotating the clamps 70 into the engaged position, and button 106B corresponds to rotating the clamps 70 into the disengaged position. Button 107A corresponds to closing the clamps 70 by moving the rams 76 toward the jaws 74, and button 107B corresponds to opening the clamps 70 by moving the rams 76 away from the jaws 74. A power-on button 108 and a power-off button 109 are also provided in the preferred embodiment of the present invention. Persons skilled in the art can select other appropriate button styles and control configurations that are compatible with the present invention.

In the preferred embodiment of the present invention, as illustrated in FIGS. 5–10, the deheading of the coke drum 32 begins by cooling the coke drum 32 and its contents, and draining the quench water from the coke drum 32 through the lateral pipe 35. After the coke drum 32 has been cooled and drained, the bottom head cover 34 is prepared for lowering by removing approximately one-half of the bolts 38 fastening the bottom head cover 34 to the bottom head flange 36, leaving empty bolt holes 39. In the preferred embodiment of the present invention, every other bolt 38 around the perimeter of bottom head cover 34 is removed, leaving a sufficient number of bolts 38 to keep the bottom head cover 34 from loosening and thereby leaking material from inside the coke drum 32.

Figure 5:
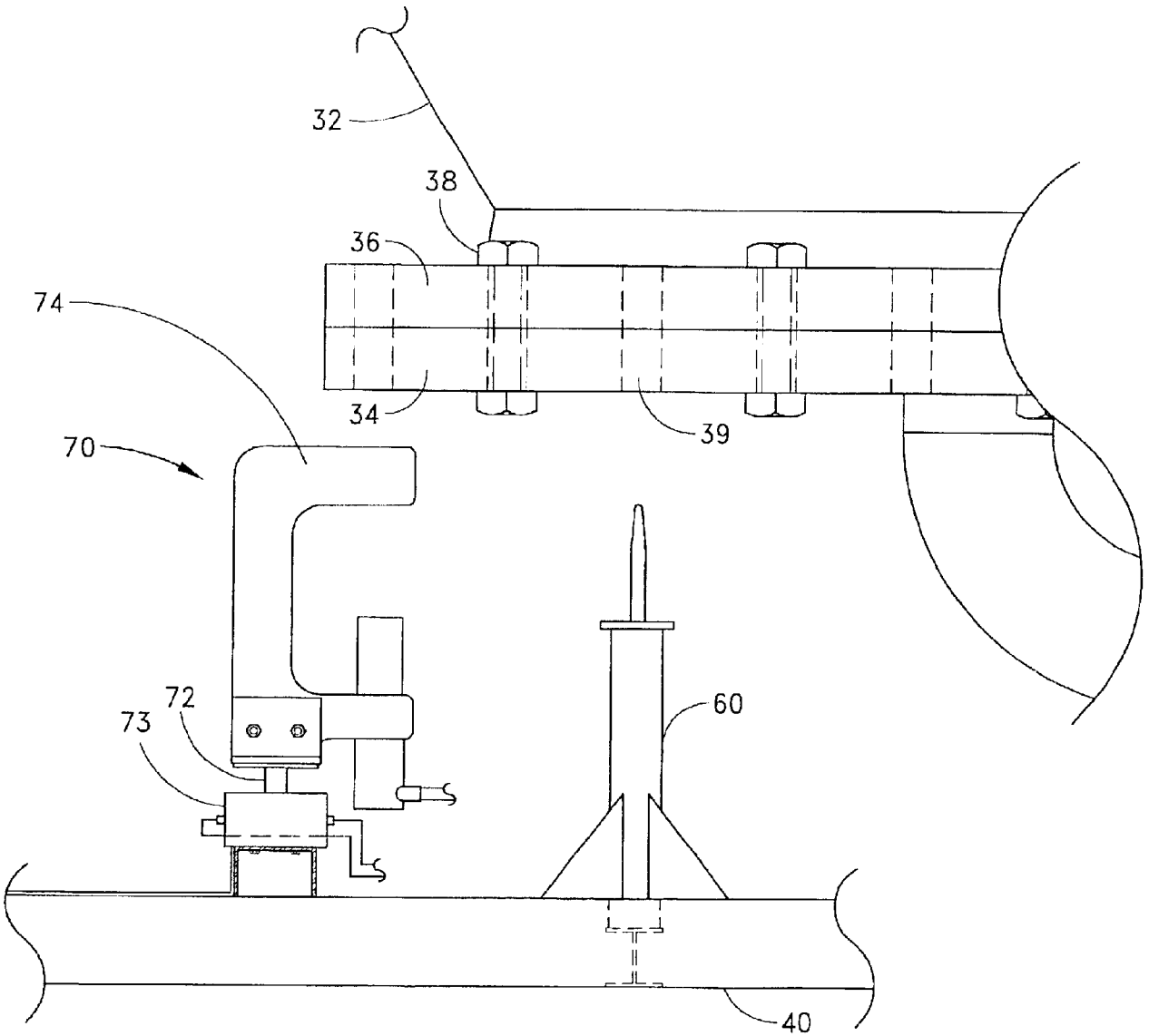
FIG. 5 is a schematic elevational view illustrating the bottom head of the coke drum with half its bolts removed and the cart in a lowered position below the bottom head.

The carriage 10 with the cart 40 in its lowered position is then translated along the tracks 20 into position below the bottom head 30, as illustrated in FIG. 5. The hoists 50 are then actuated to lift the cart 40 into its raised position with the clamps 70 in their disengaged and fully opened position. In the raised position of the cart 40, as illustrated in FIG. 6, the upper portion 62 of each support 60 engages an empty bolt hole 39 of at least the bottom head cover 34, with the shelf 64 of each support 60 being spaced approximately one inch below the lower surface of the bottom head cover 34.

Figure 6:
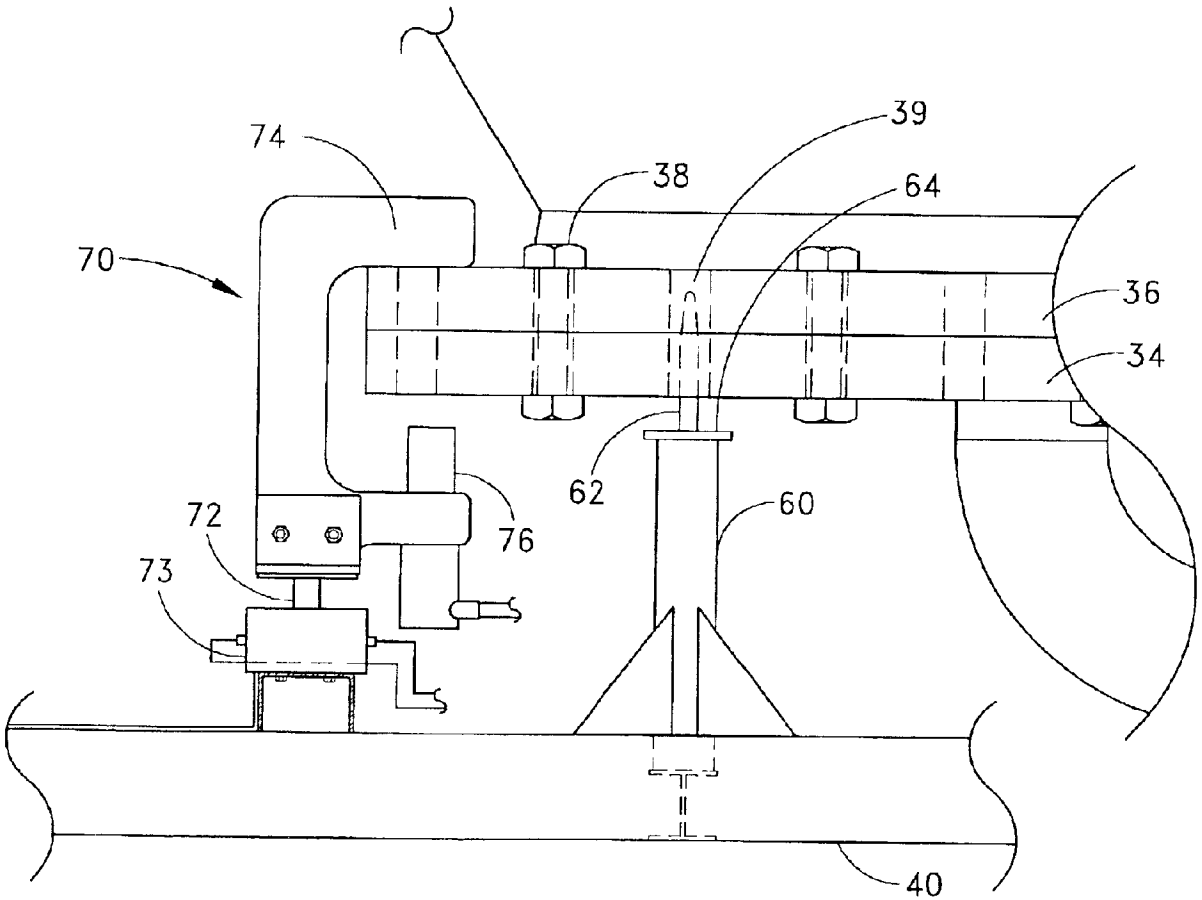
FIG. 6 is a schematic elevational view illustrating the cart in a raised position, and showing the supports engaged with aligned fastener holes in the bottom head cover and the bottom head flange.
Figure 7:
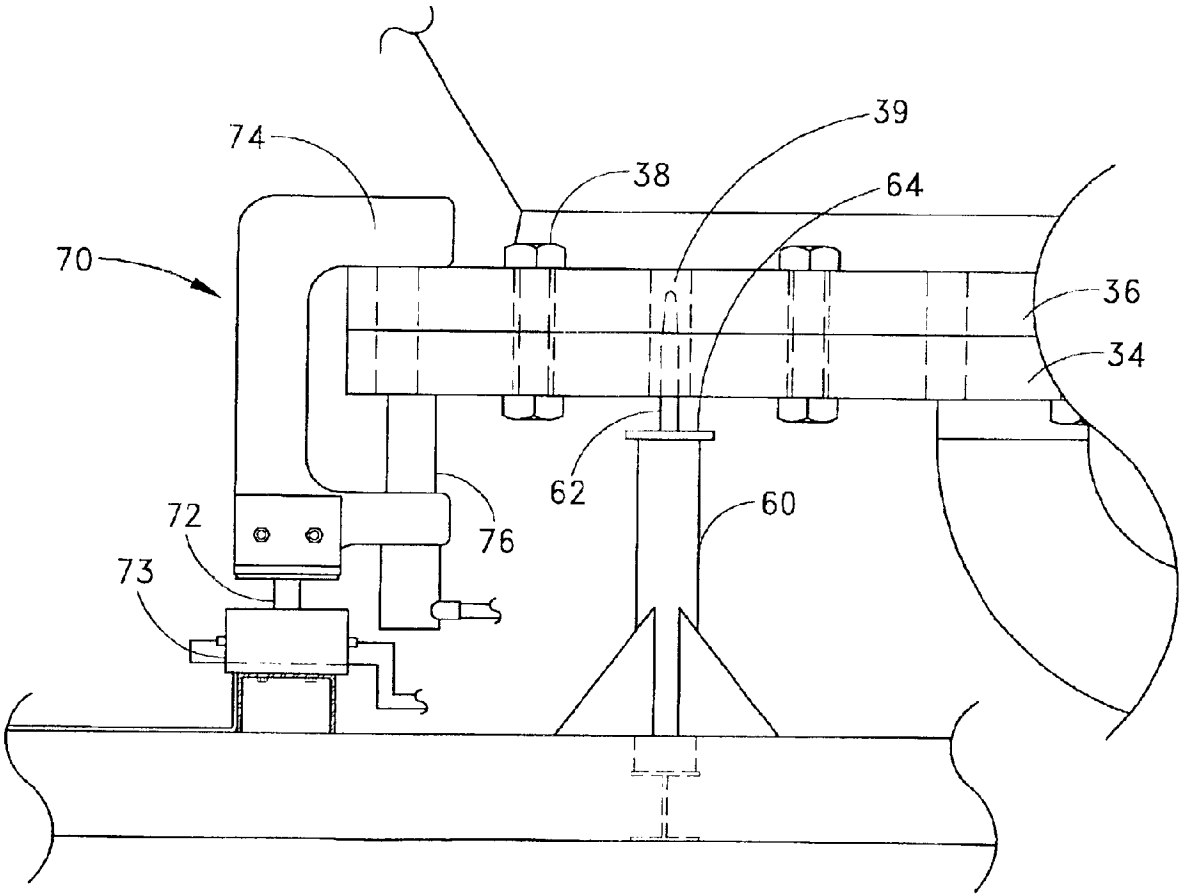
FIG. 7 is another schematic elevational view illustrating the bottom head cover and the bottom head flange being compressed together by the clamp.

By operating the rotary actuators 73, the clamps 70 are then rotated to the engaged position as illustrated in FIG. 6. In this position, the jaw 74 of each clamp 70 is engaged with the top surface of the bottom head flange 36 in proximity to an empty bolt hole 39. Both the bottom head cover 34 and the bottom head flange 36 are thereby positioned between the jaw 74 and the ram 76 of each clamp 70. By pressurizing the rams 76 of the clamps 70 by activating the hydraulic pumps 80, the clamps 70 are closed onto the bottom head cover 34 and bottom head flange 36, as illustrated in FIG. 7, thereby applying a compressive force pressing the bottom head cover 34 and the bottom head flange 36 tightly together in substantially fluid tight engagement. The hydraulic pumps 80 are operated until the hydraulic pressure reaches its maximum setting. At this maximum setting, the sum of the compressive forces of the clamps 70 is sufficient to support the combined weight of the bottom head cover 34 and the contents of the coke drum 32 weighing on the bottom head cover 34. In addition, the compressive forces preferably are applied substantially symmetrically around the perimeter of the bottom head cover 34, as illustrated in FIG. 3.

Figure 8:
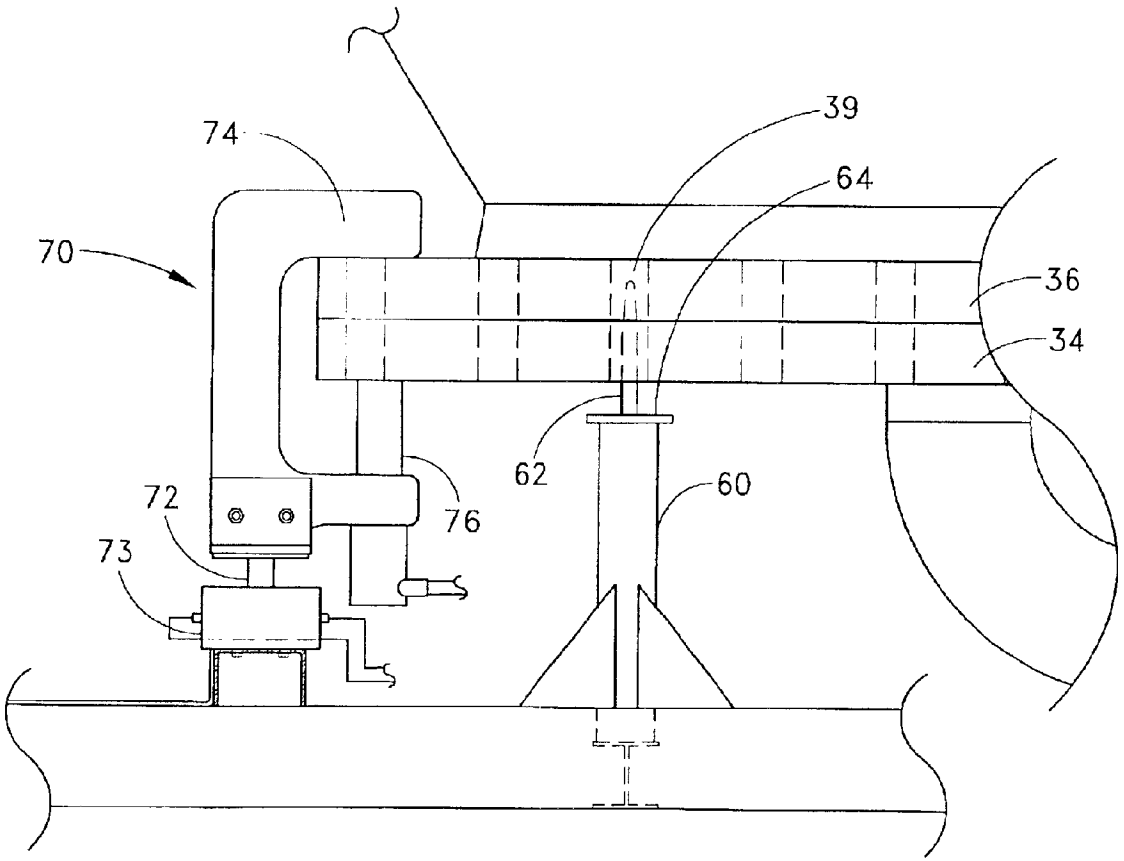
FIG. 8 is another schematic elevational view illustrating the system after the remaining fasteners have been removed from the bottom head cover and bottom head flange.

With the bottom head cover 34 securely held onto the bottom head flange 36 by the clamps 70, the remaining bolts 38 can safely be loosened and removed from the bolt holes 39 by personnel without the risk of leakage of material from inside the coke drum 32, as illustrated in FIG. 8. In addition, the fasteners 31 holding the lateral pipe flanges 37 together are removed after a manual clamp (not shown) is placed over the lateral connection flanges 37 to maintain their closure. Once the bolts 38 are removed from the bottom head 30, the personnel move to a remote location for the subsequent stage of the deheading procedure.

Figure 9:
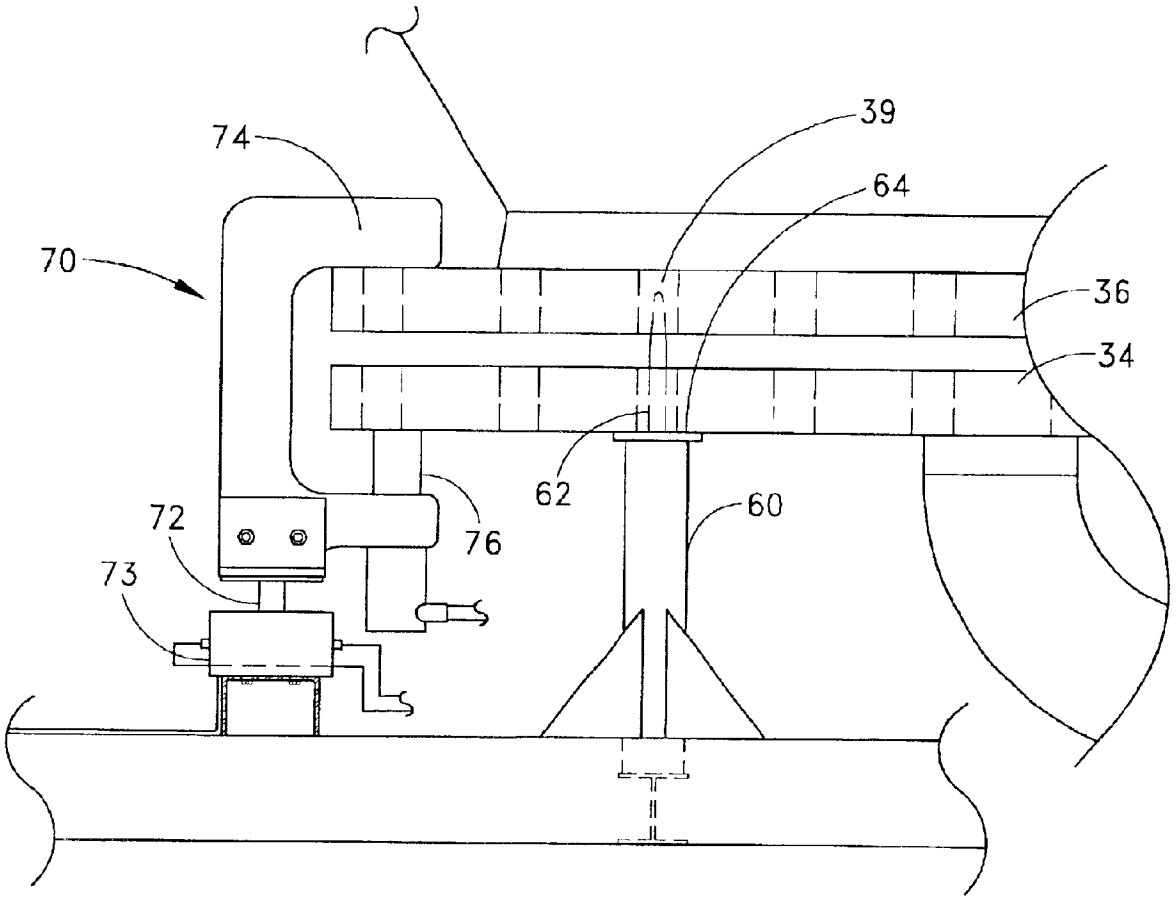
FIG. 9 is another schematic elevational view illustrating the bottom head cover lowered from the bottom head flange and the resulting gap through which materials remaining in the coke drum pass.

The hydraulic pressure applied to the rams 76 of the clamps 70 is then reduced, thereby controllably relieving the compressive force applied to the bottom head cover 34 and bottom head flange 36. When the compressive force is reduced below the combined weight of the bottom head cover 34 and the contents of the coke drum 32 weighing on the bottom head cover 34, the rams 76 begin to retract and the bottom head cover 34 separates slightly from the bottom head flange 36, as illustrated in FIG. 9. The resulting gap allows quench water and loose coke remaining in the coke drum 32 to flow out of the coke drum 32 while personnel are safely away from the bottom head 30.

The bottom head cover 34 is eventually lowered onto the support shelves 64 of the supports 60, such that the weight of the bottom head cover 34 is supported by the supports 60 of the cart 40, and not the bottom head flange 36 and the clamps 70. With the personnel safely away from the bottom head 30, the manual clamp holding the lateral pipe flanges 37 together is then released.

Figure 10:
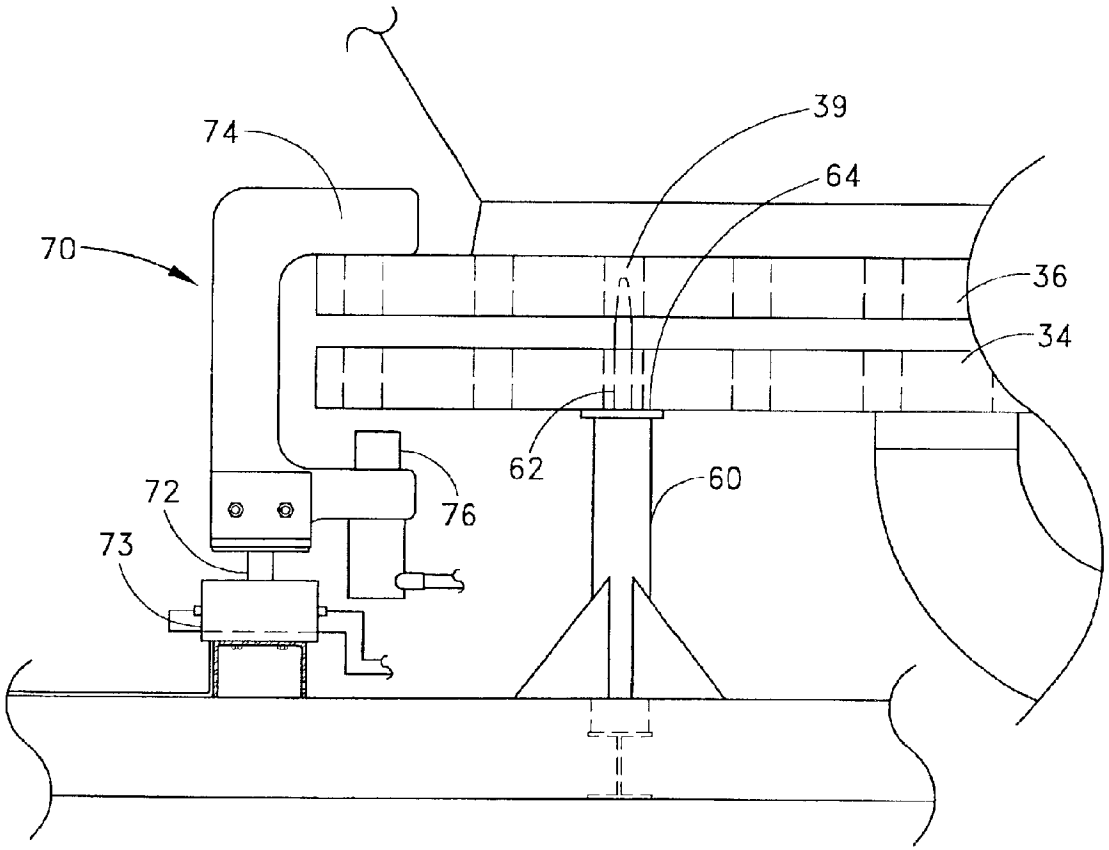
FIG. 10 is another schematic elevational view showing the clamp released from the bottom head cover to allow complete removal of the bottom head cover from the coke drum.

Once the bottom head cover 34 is fully resting on the supports 60, the rams 76 are fully retracted, as illustrated in FIG. 10, and the clamps 70 are moved away from the bottom head flange 36 to their disengaged position. This provides sufficient clearance for the cart 40 to be lowered away from the bottom head flange 36, and then the carriage 10 can be translated away from the bottom head 30 so that the decoking operation may continue.

This invention may be embodied in other specific forms without departing from the essential characteristics as described herein. The embodiments described above are to be considered in all respects as illustrative only and not restrictive in any manner. The scope of the invention is indicated by the following claims rather than by the foregoing description. Any and all changes which come within the meaning and range of equivalency of the claims are to be considered within their scope.

What is claimed is:

1. A coke drum bottom head removal system for removing the bottom head cover of a coke drum, wherein the bottom head cover is coupled by fasteners to a bottom head flange, the coke drum bottom head removal system comprising:

a cart that is positionable beneath the bottom head cover and which can be moved vertically between a raised position and a lowered position;

a plurality of clamps mounted on the cart, each clamp comprising an upper clamping surface adapted for engagement with the bottom head flange and a lower clamping surface adapted for engagement with the bottom head cover, wherein each clamp has a closed position, in which the clamping surfaces apply a compressive force that maintains a substantially fluid tight engagement between the bottom head flange and the bottom head cover upon removal of the fasteners, and an opened position, in which the clamping surfaces are moved apart to permit a limited spacing between the bottom head flange and the bottom head cover when the fasteners are removed;

a plurality of supports mounted on the cart that are adapted to support the bottom head cover when the fasteners are removed and the clamps are in the opened position; and a controller connected to the clamps and adapted to be operated from a remote location for controlling operation of the clamps.

2. The coke drum bottom head removal system of claim 1, further comprising a carriage on which the cart is mounted, wherein the carriage is suspended by a plurality of trolleys from a pair of overhead tracks positioned along opposite sides of the bottom head cover.

3. The coke drum bottom head removal system of claim 2, wherein the trolleys are pneumatically actuated via the controller to position the carriage beneath the bottom head cover.

4. The coke drum bottom head removal system of claim 1, wherein the cart is suspended from an upper portion of the carriage by a plurality of hoists.

5. The coke drum bottom head removal system of claim 4, wherein the hoists are pneumatically actuated via the controller to position the cart between the raised position and the lowered position, as well as a plurality of intermediate positions between the raised and lowered positions.

6. The coke drum bottom head removal system of claim 1, wherein each clamp is vertically mounted to the cart by a rotatable shaft and a rotary actuator.

7. The coke drum bottom head removal system of claim 6, wherein each rotary actuator is pneumatically actuated via the controller to rotate each clamp between an engaged position, in which the bottom head cover and the bottom head flange are between the clamping surfaces, and a disengaged position, in which the bottom head cover and the bottom head flange are not between the clamping surfaces, and wherein the clamp can be actuated via the controller for rotation between the engaged position and the disengaged position.

8. The coke drum bottom head removal system of claim 1, wherein the clamps are coupled to at least one hydraulic pump which produces the compressive force applied by the clamping surfaces.

9. The coke drum bottom head removal system of claim 8, wherein the upper clamping surface comprises a fixed jaw and the lower clamping surface comprises a moveable ram.

10. The coke drum bottom head removal system of claim 8, wherein the controller comprises a control panel coupled to the at least one hydraulic pump to remotely adjust the hydraulic pressure applied to the clamps.

11. A coke drum bottom head removal system for removing the bottom head cover of a coke drum, wherein the bottom head cover is coupled by fasteners to a bottom head flange, the coke drum bottom head removal system comprising:

a carriage that is positionable beneath the bottom head cover;

a cart mounted on the carriage, wherein the cart is adapted to be moved vertically between a raised position and a lowered position;

a plurality of clamps mounted on the cart, each clamp comprising a jaw adapted for engagement with the bottom head flange and a moveable ram adapted for engagement with the bottom head cover, wherein each clamp has a closed position, in which the ram is extended to apply a compressive force that maintains a substantially fluid tight engagement between the bottom head flange and the bottom head cover upon removal of the fasteners, and an opened position, in which the ram is retracted to permit a limited spacing between the bottom head flange and the bottom head cover when the fasteners are removed;

a plurality of supports mounted on the cart that are adapted to support the bottom head cover when the fasteners are removed and the clamps are in the opened position; and a controller connected to the clamps and adapted to control the operation of the clamps from a remote location.

12. A method of removing a bottom head cover attached by fasteners to a bottom head flange of a coke drum, comprising:

applying a compressive force to the bottom head cover and the bottom head flange to maintain a substantially fluid tight engagement between them;

removing the fasteners that attach the bottom head cover to the bottom head flange;

reducing the compressive force to allow the bottom head cover to be lowered a limited distance with respect to the bottom head flange;

supporting the bottom head cover with respect to the bottom head flange;

releasing substantially all compressive force; and removing the bottom head cover.

13. A method of removing a bottom head cover attached by fasteners to a bottom head flange of a coke drum, comprising:

removing a limited number of the fasteners to expose fastener holes in the bottom head cover and the bottom head flange;

partially inserting elongated supports through a plurality of the fastener holes, wherein each support has a support surface spaced below the bottom head cover;

applying a compressive force to the bottom head cover and the bottom head flange to maintain a substantially fluid tight engagement between them;

removing the remaining fasteners;

reducing the compressive force from a remote location to allow the bottom head cover to be lowered onto the support surface of each support, to thereby space the bottom head cover a limited distance with respect to the bottom head flange; and transporting the bottom head cover away from the bottom head flange.

14. A method of removing a bottom head cover attached by fasteners to a bottom head flange of a coke drum utilizing a carriage, a cart mounted on the carriage, a plurality of clamps mounted on the cart, each clamp comprising an upper clamping surface adapted for engagement with the bottom head flange and a lower clamping surface adapted for engagement with the bottom head cover, wherein each clamp has a closed position, in which the clamping surfaces apply a compressive force that maintains a substantially fluid tight engagement between the bottom head flange and the bottom head cover upon removal of the fasteners, and an opened position, in which the clamping surfaces are moved apart to permit a limited spacing between the bottom head flange and the bottom head cover when the fasteners are removed, and a plurality of supports on the cart that support the bottom head cover once the fasteners are removed, the method comprising:

positioning the carriage beneath the bottom head cover;

moving the cart to a raised position;

positioning the clamps in the closed position;

removing fasteners coupling the bottom head cover to the bottom head flange;

positioning the clamps in the opened position;

lowering the bottom head cover onto the plurality of supports; and removing the bottom head cover.

15. The method of claim 14, wherein the compressive force is applied by a plurality of hydraulically actuated clamps.

16. The method of claim 14, wherein the compressive force clamping the bottom head cover against the bottom head flange is applied substantially symmetrically.

17. The method of claim 14, wherein the bottom head cover is lowered onto the plurality of supports by remotely adjusting a hydraulic pressure applied to the plurality of clamps.

* * * * *